US008776271B2

(12) United States Patent
Randolph

(10) Patent No.: US 8,776,271 B2
(45) Date of Patent: Jul. 15, 2014

(54) SELECTIVE ORNAMENTATION SYSTEM

(75) Inventor: Kristen M Randolph, Virginia Beach, VA (US)

(73) Assignee: KMMR, LLC, Virginia Beach, VA (US)

( * ) Notice: Subject to any disclaimer, the term of this patent is extended or adjusted under 35 U.S.C. 154(b) by 512 days.

(21) Appl. No.: 12/932,809

(22) Filed: Mar. 7, 2011

(65) Prior Publication Data

US 2013/0091620 A1 Apr. 18, 2013

Related U.S. Application Data

(60) Provisional application No. 61/382,968, filed on Sep. 15, 2010.

(51) Int. Cl.

| | |
|---|---|
| ***A43B 23/24*** | (2006.01) |
| ***A45D 8/34*** | (2006.01) |
| ***A41D 27/08*** | (2006.01) |
| *A44C 25/00* | (2006.01) |

(52) U.S. Cl.

CPC *A41D 27/08* (2013.01); *A45D 8/34* (2013.01); *A44C 25/00* (2013.01); *A43B 23/24* (2013.01)

USPC ..... 2/245; 2/312

(58) Field of Classification Search

USPC ..... 36/132, 136, 101; 24/90.1, 303; 2/311, 2/313, 319, 322, 321, 338, 312, 245

See application file for complete search history.

(56) References Cited

U.S. PATENT DOCUMENTS

| | | | | | |
|---|---|---|---|---|---|
| 837,399 | A * | 12/1906 | Gooding | 2/320 |
| 1,060,229 | A * | 4/1913 | Casper | 40/640 |
| 1,583,274 | A * | 5/1926 | Bostock | 36/136 |
| 2,596,884 | A * | 5/1952 | Bailen | 40/640 |
| 4,521,923 | A * | 6/1985 | Mackey | 2/338 |
| 4,581,271 | A * | 4/1986 | Gordon | 428/67 |
| 4,691,460 | A * | 9/1987 | Kohl | 40/618 |
| 5,136,726 | A * | 8/1992 | Kellin et al. | 2/244 |
| 5,800,900 | A * | 9/1998 | Mitchell | 428/100 |
| 5,852,829 | A * | 12/1998 | Relaford | 2/338 |
| 6,012,203 | A * | 1/2000 | Baron Pearson | 24/114.9 |
| 6,115,948 | A * | 9/2000 | Mitchell | 36/136 |
| 6,769,204 | B1 * | 8/2004 | Phillips | 36/136 |
| 7,698,836 | B2 * | 4/2010 | Schmelzer et al. | 36/136 |
| 7,833,085 | B2 * | 11/2010 | Crouch | 450/86 |
| 8,099,794 | B2 * | 1/2012 | Carstens | 2/16 |
| 2003/0101625 | A1 | 6/2003 | Wu | |
| 2004/0093765 | A1 * | 5/2004 | Baldwin | 36/101 |
| 2006/0048408 | A1 * | 3/2006 | Spann | 36/11.5 |
| 2006/0162051 | A1 * | 7/2006 | Bachechi | 2/338 |
| 2009/0151202 | A1 | 6/2009 | Kramer et al. | |
| 2009/0289090 | A1 * | 11/2009 | Fullerton et al. | 224/183 |
| 2012/0144562 | A1 * | 6/2012 | Ferrara et al. | 2/338 |
| 2012/0216374 | A1 * | 8/2012 | Manuello | 24/303 |
| 2013/0091620 | A1 * | 4/2013 | Randolph | 2/244 |

* cited by examiner

*Primary Examiner* — Clinton T Ostrup

*Assistant Examiner* — Andrew W Sutton

(74) *Attorney, Agent, or Firm* — Peter J. Van Bergen

(57) ABSTRACT

A decorative strap system includes a strap with individual compartments defined therein. Each compartment is accessible via its own opening. A magnetic material piece is selectively placed in one or more of the compartments via the openings associated therewith. At least one ornament is provided where each such ornament incorporates an element for magnetic cooperation with one of the magnetic material pieces so-selectively placed.

6 Claims, 3 Drawing Sheets

SELECTIVE ORNAMENTATION SYSTEM

Pursuant to 35 U.S.C. §119, the benefit of priority from provisional application 61/382,968, with a filing date of Sep. 15, 2010, is claimed for this non-provisional application.

FIELD OF THE INVENTION

The invention relates generally to ornamentation for apparel, and more particularly to a system for the selective ornamentation of a strap incorporated in a piece of apparel or forming a piece of apparel.

BACKGROUND OF THE INVENTION

The ornamentation of shoes, boots, etc. (or other articles of apparel) can be permanently designed into a shoe (or other apparel). However, once the ornamentation is no longer in favor or in fashion, the shoe (or other apparel) is typically cast aside, given away, or even thrown away. Very often, such items will still have quite a bit of useful life left in them. To combat such premature obsolescence, some shoe designers have suggested permanently fixing magnets or magnetic materials into shoe linings at certain areas of the shoe. Ornaments incorporating magnetically complementary material are then placed on the shoe where the magnets or magnetic materials are embedded. However, a user can only place an ornament where the shoe manufacturer has placed the magnets or magnetic materials. For the shoe manufacturer to give the user a large number of ornament placement options, the shoe manufacturer would have to emplace magnets or magnetic materials in a number of places on the shoe. This adds to the overall expense and weight of the shoe.

SUMMARY OF THE INVENTION

Accordingly, it is an object of the present invention to provide a system that allows a user to selectively ornament a shoe or other article of apparel.

Another object of the present invention is to provide a selective ornamentation system for shoes or other articles of apparel where the user can selectively use zero, one or multiple items of ornamentation.

Other objects and advantages of the present invention will become more obvious hereinafter in the specification and drawings.

In accordance with the present invention, a decorative strap system includes a strap with a plurality of individual compartments defined therein. Each compartment is accessible via an opening associated therewith that is formed in the strap. A piece of material having magnetic properties is selectively placed in one or more of the compartments via the openings associated therewith. At least one ornament is provided. Each such ornament incorporates an element for magnetic cooperation with one of the pieces of material so-selectively placed.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
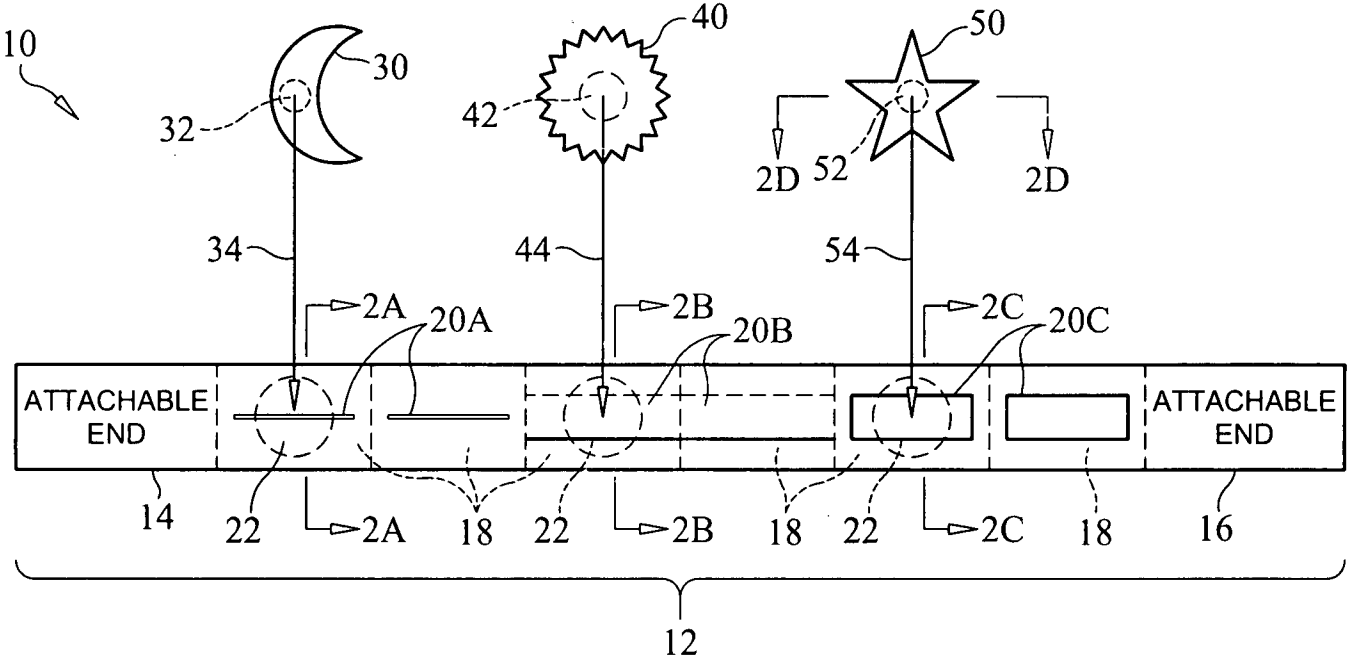
FIG. 1 is a plan view of a decorative strap system configured for the selective ornamentation thereof in accordance with an embodiment of the present invention.

Referring now to the drawings and more particularly to FIG. 1, a decorative strap system in accordance with an embodiment of the present invention is shown and is referenced generally by numeral 10. In this embodiment, strap system 10 is configured as an article of apparel that can be purely decorative in function or provide utility as well as decoration without departing from the scope of the present invention. For example, and as will be explained later below, strap system 10 can be a purely decorative accessory added to an existing article of apparel or worn by a user. However, strap system 10 could also provide utility as well as decoration if configured as a belt, hairband, etc. Accordingly, it is to be understood that the size, shape, and materials used for strap system 10 are not limitations of the present invention.

Strap system 10 includes a strap 12 having attachable ends 14 and 16. Strap 12 will typically be non-magnetic and flexible, and can be made from a variety of materials to include fabric, leather, vinyl, rubber, links of rigid material joined at points of flexure, etc., and combinations thereof. Attachable ends 14 and 16 can be configured in any of a variety of ways that allow strap 12 to be formed into a loop of fixed or adjustable size. For example, ends 14/16 could be configured with belt buckle hardware, snaps, hook and eye, "hook and loop" fastener materials, button/buttonhole, etc., the choices of which are not limitations of the present invention. Further, strap 12 could be constructed as a continuous loop of stretchable material (e.g., as in the case of a headband) in which case ends 14/16 could be omitted.

Regardless of its material/construction, strap 12 defines a number of individual compartments 18 along the length thereof where each compartment 18 is defined between two vertical dashed lines extending across strap 12. Although compartments 18 are illustrated all along the length of strap 12 in an adjacent fashion, the present invention is not so limited as compartments 18 could be spaced apart from one another or only provided in region(s) of strap 12. Compartments 18 can be integral with the design of strap 12, or could be separately constructed and coupled to strap 12 without departing from the scope of the present invention.

In the illustrated embodiment and as will be described later below, strap 12 includes two facing layers of flexible material coupled together in a selective fashion to define strap 12 and compartments 18. A variety of one or more techniques can be used to couple the layers together that forms strap 12 with compartments 18. Such techniques include, but are not limited to, stitching, stapling, riveting, fusing, and gluing. The choice of technique(s) could be predicated on the materials used to construct strap 12, the decorative purpose of strap 12, the cost of strap system 10, the desired flexibility of strap 12, etc.

Regardless of the construction of strap 12 and its compartments 18, each of compartments 18 is provided with or incorporates an opening that provides access to the compartment. In the illustrated embodiment, three exemplary types of openings 20A, 20B and 20C are illustrated. It is to be understood that a strap system of the present invention could utilize different types of openings (as illustrated) or openings that are all the same. Further, other types of openings could also be used without departing from the scope of the present invention.

Regardless of its construction, each opening 20A, 20B, and 20C should be sized/configured to provide for the insertion, retention and removal of a piece 22 of magnetic material. As used herein and as would be understood by one of ordinary skill in the art, the term "magnetic material" includes permanent magnets, materials that can be magnetized, and materials that are attracted to magnets. While geometry of each piece 22 is not a limitation of the present invention, a circular disk geometry used in the illustrated embodiment facilitates insertion into and removal from a compartment's opening while also eliminating any sharp edges/points that could damage strap 12 or hurt a user.

One or more of pieces 22 can be used when a user wants to adorn strap 12 with ornamentation. The selective placement of the one or more pieces 22 allows a user to customize the location of the strap's ornamentation for a particular application, day, evening, event, etc. That is, the plurality of compartments 18 combined with the ability to selectively place one or more pieces 22 allows a user to design/re-design the ornamentation of strap system 10 in a wide variety of ways using only the requisite number of pieces 22 needed to achieve the desired ornamentation.

Figure 2A:
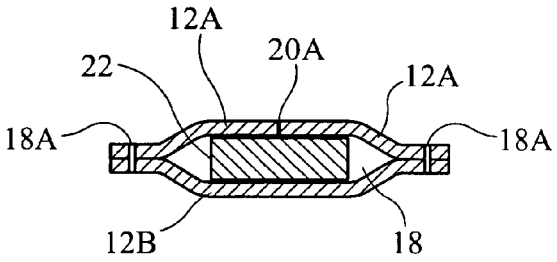
FIG. 2A is a cross-sectional view of the strap in FIG. 1 taken along line 2A-2A thereof illustrating a compartment opening in accordance with an embodiment of the present invention.
Figure 2B:
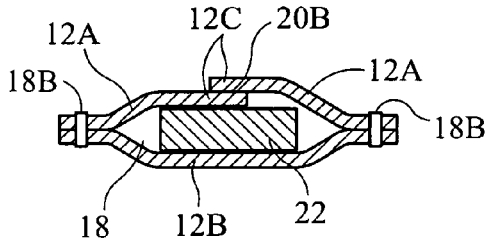
FIG. 2B is a cross-sectional view of the strap in FIG. 1 taken along line 2B-2B thereof illustrating a compartment opening in accordance with another embodiment of the present invention.
Figure 2C:
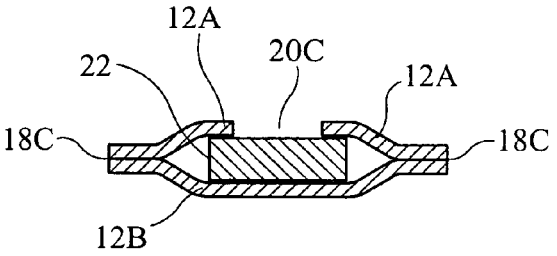
FIG. 2C is a cross-sectional view of the strap in FIG. 1 taken along line 2C-2C thereof illustrating a compartment opening in accordance with another embodiment of the present invention.

Referring additionally now to FIGS. 2A-2C, exemplary openings 20A, 20B and 20C will be described. In the cross-sectional view of FIG. 2A, opening 20A is constructed as a button hole formed in one layer 12A of a strap 12 constructed from two opposing layers 12A and 12B. Compartment 18 is defined by stitching on either side of compartment 18 (i.e., the vertical dashed lines in FIG. 1) and along the opposing longitudinal edges of strap 12 as indicated at 18A in FIG. 2A.

In the cross-sectional view of FIG. 2B, opening 20B is defined by overlapping flaps 12C formed in layer 12A of strap 12. Compartment 18 can be defined by individual or rivets on either side of compartment 18 (i.e., the vertical dashed lines in FIG. 1) and along the opposing longitudinal edges of strap 12 as indicated at 18B in FIG. 2B.

In the cross-sectional view of FIG. 2C, opening 20C is constructed as an open slot in layer 12A thereby exposing a portion of piece 22. Such exposure of piece 22 will enhance the strength of attachment of an ornament to strap system 10 as will be explained later below. Compartment 18 can be defined by fusing or gluing on either side of compartment 18 (i.e., the vertical dashed lines in FIG. 1) and along the opposing longitudinal edges of strap 12 as indicated at 18C in FIG. 2C.

As mentioned above, strap 12 can utilize the same type or different types of opening (i.e., 20A, 20B, and 20C). Openings 20A and 20B could face towards or away from the apparel, article, or body part, to which strap 12 is attached whereas openings 20C would face away from the apparel article or body part for reasons that will become clearer below. Ornaments are selectively positioned on strap 12 wherever pieces 22 are located. For example, in the illustrated embodiment, three ornaments 30, 40, and 50 are provided for magnetic engagement with one of pieces 22. Ornaments 30 and 40 include a respective element 32 and 42 attached thereto or incorporated therein (e.g., forming part of the ornament itself, a non-ornamental element between layers of ornament 30 or 40, etc.) with element 32 and 42 being magnetically attracted to one of pieces 22. Accordingly, elements 32 and 42 can be a magnet or made from a material that is attracted to a magnet. That is, elements 32 and 42 are the magnetic complement of piece 22. For clarity of illustration, ornaments 30 and 40 are displaced from strap 12 with arrows 34 and 44 being indicative of the respective magnetic attraction force between elements 32 and 42 and one of pieces 22. Magnetic attraction forces 34 and 44 must be sufficient to hold ornament 30 in place given the type/thickness of any materials disposed between elements 32/42 and pieces 22.

Figure 2D:
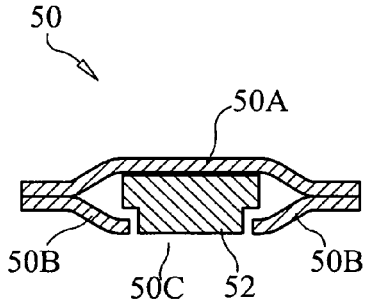
FIG. 2D is a cross-sectional view of an ornament and its magnetic element in accordance with an embodiment of the present invention.

Ornament 50 is designed to cooperate with opening 20C that exposes a portion of piece 22. Referring additionally to FIG. 2D, ornament 50 has magnetic element 52 disposed and retained between opposing layers 50A and 50B with an opening 50C allowing a portion of element 52 to be exposed. In this way, when ornament 50 is placed up to strap 12, the exposed portion of element 52 will be able to directly contact the exposed portion of piece 22 so that the resulting magnetic attraction force 54 is stronger to retain ornament 50 on strap 12 in a more secure fashion. The shape of piece 22 and element 52 can be adjusted to facilitate or enhance this direct type of contact. For example, piece 22 could incorporate a depression for reception of a complementary protrusion formed on element 52. Note that the partial exposure of piece 22 could also provide enhanced attraction to element 52 even if element 52 were contained fully between layers 50A and 50B where no opening 50C existed.

Figure 3:
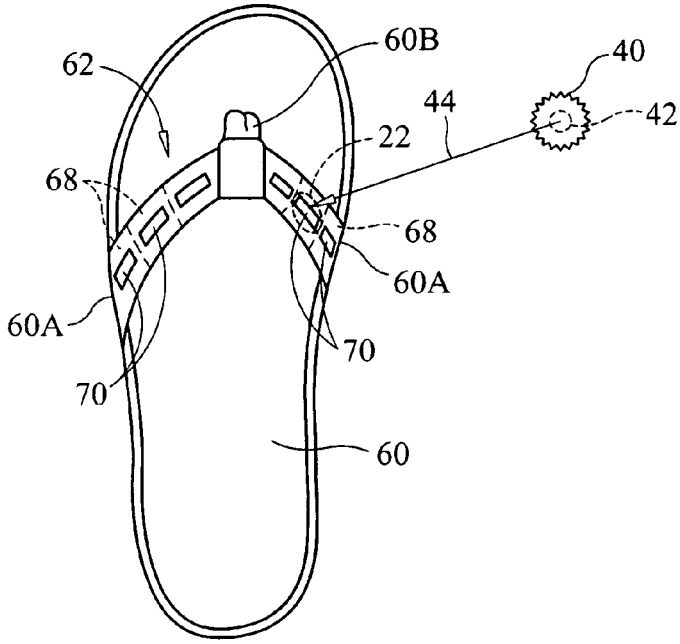
FIG. 3 is a plan view of a sandal that incorporates the decorative strap system of the present invention.

The strap system of the present invention can be a stand-alone item as just described or could be incorporated into an article of apparel. For example, FIG. 3 illustrates a sandal 60 having a strap 62 attached to the sides 60A and a center toe separator 60B thereof as would be well understood in the art. Strap 62 is configured similar to strap 12 so that multiple compartments 68 are defined therealong with each compartment 68 being accessible via an opening 70 (e.g., a buttonhole). In the illustrated embodiment, a single piece 22 of magnetic material is placed in one of compartments 68 so that ornament 40 can be magnetically coupled thereto via magnetic attraction force 44.

Figure 4:
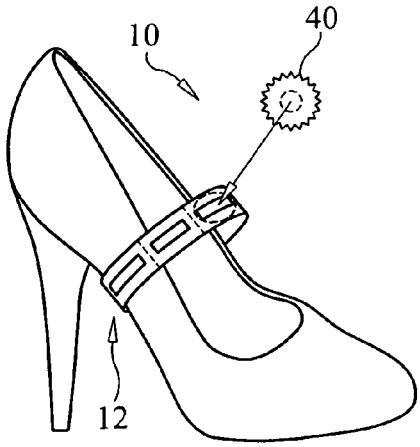
FIG. 4 is a side view of a shoe with a strap system of the present invention wrapped about a portion of the shoe.
Figure 5:
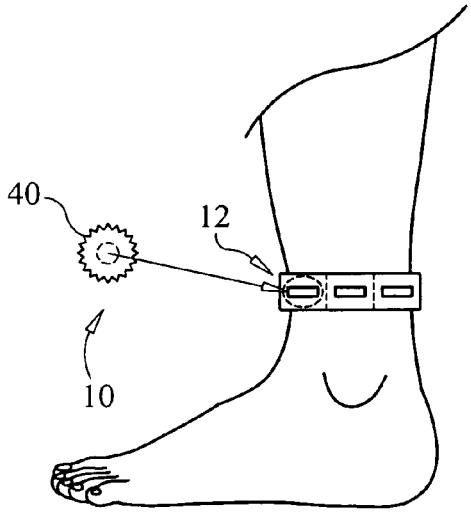
FIG. 5 is a side view of a strap system of the present invention being worn by user around their ankle.

In another application of the present invention, a stand-alone strap system 10 as described above can be wrapped around a portion of a shoe 100 as illustrated in FIG. 4. In still another application of the present invention, a stand-alone strap system 10 can be worn as an article of apparel as illustrated in FIG. 5 where strap system 10 is wrapped about a user's ankle 200. A variety of other applications (e.g., necklace, belt, headband, etc.) predicated on the present invention can be constructed simply by tailoring the size and/or materials used for the strap system.

The advantages of the present invention are numerous. The decorative strap system allows a user to customize ornamentations and the positions thereof by simply adjusting locations of magnetic material pieces in user-recognizable compartments. This will extend the useful life of a variety of fashion items and articles of apparel while minimizing the weight of the strap system since magnetic materials are selectively positioned. The strap system can be used as a stand-alone item or can be incorporated into articles of apparel. A user could carry different types of ornamentations so that the strap system could be readily changed to accommodate a different style of dress (e.g., changing from a day style to an evening style) without needing another article of apparel.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A decorative strap system, comprising:

a strap made from two layers of flexible material, said strap adapted to be coupled to an article of footwear;

a plurality of individual compartments defined within said strap, each of said compartments being accessible via an opening associated therewith that is defined between overlapping but unattached edge portions of one of said two layers;

at least one piece of material having magnetic properties, each said piece of material selectively placed in one of said compartments via said opening associated therewith, wherein each said piece of material is inserted in and removed from said one of said compartments via said opening associated therewith, and wherein said each piece of material is retained within said one of said compartments by said overlapping and unattached edge portions associated with said opening; and at least one ornament incorporating an element for magnetic cooperation with one said piece of material placed in one of said compartments, wherein each said ornament is retained on said strap.

2. A decorative strap system as in claim 1, wherein said compartments are defined by at least one technique selected from the group consisting of stitching, stapling, riveting, fusing, and gluing.

3. A decorative strap system, comprising:

magnetic material pieces;

a strap made from two layers of flexible material, said strap adapted to be coupled to an article of footwear;

a plurality of individual compartments defined within said strap, each of said compartments being accessible via an opening associated therewith that is defined between overlapping but unattached edge portions of one of said two layers, each of said compartments and said opening associated therewith sized to permit insertion, retention, and removal of one of said magnetic material pieces, wherein one of said magnetic material pieces is inserted in and removed from said one of said compartments via said opening associated therewith, and wherein said one of said magnetic material pieces is retained within said one of said compartments by said overlapping and unattached edge portions associated with said opening; and at least one ornament incorporating an element for magnetic cooperation with one of said magnetic material pieces retained in one of said compartments, wherein each said ornament is retained on said strap.

4. A decorative strap system as in claim 3, wherein said compartments are defined by at least one technique selected from the group consisting of stitching, stapling, riveting, fusing, and gluing.

5. A decorative strap system, comprising:

a plurality of magnets;

a flexible strap that includes two separate layers of material facing one another, said strap adapted to be coupled to an article of footwear;

a plurality of individual compartments defined between said two layers, each of said compartments being accessible via an opening associated therewith that is defined between overlapping but unattached edge portions of one of said two layers, each of said compartments and said opening associated therewith sized to permit insertion, retention, and removal of one of said magnets, wherein one of said magnets is inserted in and removed from said one of said compartments via said opening associated therewith, and wherein said one of said magnets is retained within said one of said compartments by said overlapping and unattached edge portions associated with said opening; and at least one ornament incorporating an element for magnetic cooperation with one of said magnets retained in one of said compartments, wherein each said ornament is retained on said strap.

6. A decorative strap system as in claim 5, wherein said compartments are defined by joining adjacent regions of said two layers to one another using at least one technique selected from the group consisting of stitching, stapling, riveting, fusing, and gluing.

* * * * *